US007861876B2

(12) United States Patent
Stowitts

(10) Patent No.: US 7,861,876 B2
(45) Date of Patent: Jan. 4, 2011

(54) BOTTLE WITH INTRUDING MARGIN VACUUM RESPONSIVE PANELS

(75) Inventor: Adam P. S. Stowitts, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 1138 days.

(21) Appl. No.: 11/525,364

(22) Filed: Sep. 22, 2006

(65) Prior Publication Data

US 2008/0073316 A1 Mar. 27, 2008

(51) Int. Cl.
*B65D 1/02* (2006.01)

(52) U.S. Cl. ..... 215/381; 215/382; 215/900; 220/666; 220/669; 220/675

(58) Field of Classification Search ..... 215/379–384, 215/900; 220/666, 669, 675
See application file for complete search history.

(56) References Cited

U.S. PATENT DOCUMENTS 4,805,788 A 2/1989 Akiho
D300,805 S 4/1989 Rogler et al.
4,863,046 A 9/1989 Collette et al.
4,877,141 A 10/1989 Hayashi et al.
4,907,709 A 3/1990 Abe et al.
D309,102 S 7/1990 Wild
D315,869 S 4/1991 Collette
5,005,716 A 4/1991 Eberle
D321,830 S 11/1991 York et al.
5,064,081 A * 11/1991 Hayashi et al. ..... 215/373
5,092,475 A 3/1992 Krishnakumar et al.
5,148,930 A * 9/1992 Ota et al. ..... 215/384
5,165,557 A * 11/1992 Ota et al. ..... 215/384
5,178,289 A 1/1993 Krishnakumar et al.
5,178,290 A 1/1993 Ota et al.
5,199,588 A 4/1993 Hayashi
5,261,543 A * 11/1993 Ugarelli ..... 215/375
D345,693 S 4/1994 Edstrom
5,303,833 A 4/1994 Hayashi et al.
5,303,834 A 4/1994 Krishnakumar et al.
5,337,909 A 8/1994 Vailliencourt
5,341,946 A * 8/1994 Vailliencourt et al. ..... 215/381
D352,245 S 11/1994 Krishnakumar et al.
D366,417 S 1/1996 Semersky
D366,831 S 2/1996 Semersky et al.
5,704,503 A 1/1998 Krishnakumar et al.
D393,802 S 4/1998 Collette et al.
5,735,420 A 4/1998 Nakamaki et al.
5,762,221 A 6/1998 Tobias et al.
D397,614 S 9/1998 Krishnakumar et al.

(Continued)

*Primary Examiner*—Sue A Weaver
(74) *Attorney, Agent, or Firm*—Brinks Hofer Gilson & Lione

(57) ABSTRACT

A container exhibiting superior resistance to unwanted or uncontrolled sidewall deformation has plurality of vacuum responsive panels, generally uniformly spaced around the sidewall periphery, including a panel surface portion radially inset from the sidewall. A post or land is provided between each nearest neighbor pair of vacuum panels, the posts having upper and lower ends joined together upper and lower sidewall edge portions. A margin is located at least at the upper and lower edges of each vacuum panel and extending between the panel surface and the sidewall. At least one of the upper and lower margins of each vacuum responsive panel includes an axially offset portion, which in response to decreasing pressure focuses any initial deflection of the panel surface to that portion of the panel contiguous to the axial offset portion.

19 Claims, 4 Drawing Sheets

U.S. PATENT DOCUMENTS

| | | | | |
|---|---|---|---|---|
| D411,453 | S | 6/1999 | Piccioli et al. | |
| 5,908,128 | A | 6/1999 | Krishnakumar et al. | |
| D419,882 | S | 2/2000 | Bretz et al. | |
| D420,592 | S | 2/2000 | Bretz et al. | |
| 6,036,037 | A | 3/2000 | Scheffer et al. | |
| 6,044,996 | A | 4/2000 | Carew et al. | |
| D426,460 | S | 6/2000 | Krishnakumar et al. | |
| D429,647 | S | 8/2000 | Warner et al. | |
| D434,330 | S | 11/2000 | Rowe et al. | |
| D438,456 | S | 3/2001 | Bretz et al. | |
| D439,167 | S | 3/2001 | Lichtman et al. | |
| D441,641 | S | 5/2001 | Piccioli et al. | |
| D445,033 | S | 7/2001 | Bretz et al. | |
| D445,036 | S | 7/2001 | Goettner et al. | |
| D445,693 | S | 7/2001 | Rashid | |
| D445,694 | S | 7/2001 | Gans | |
| D446,126 | S | 8/2001 | Bretz et al. | |
| D446,458 | S | 8/2001 | Gans | |
| D451,401 | S | 12/2001 | Silvers et al. | |
| 6,347,717 | B1 * | 2/2002 | Eberle | 215/381 |
| D454,500 | S | 3/2002 | Bretz et al. | |
| 6,439,413 | B1 * | 8/2002 | Prevot et al. | 215/381 |
| 6,460,714 | B1 | 10/2002 | Silvers et al. | |
| D465,158 | S | 11/2002 | Peek et al. | |
| D466,021 | S | 11/2002 | Thierjung et al. | |
| D472,470 | S | 4/2003 | Bretz et al. | |
| 6,554,146 | B1 | 4/2003 | DeGroff et al. | |
| D476,236 | S | 6/2003 | Ungrady et al. | |
| 6,585,125 | B1 | 7/2003 | Peek | |
| D479,690 | S | 9/2003 | DeGroff | |
| D480,313 | S | 10/2003 | Johnson et al. | |
| D485,765 | S | 1/2004 | Thierjung et al. | |
| D488,722 | S | 4/2004 | Evans et al. | |
| D488,723 | S | 4/2004 | Evans et al. | |
| D494,475 | S | 8/2004 | Thierjung et al. | |
| D497,551 | S | 10/2004 | Gamel et al. | |
| D502,108 | S | 2/2005 | Gamel et al. | |
| 6,981,604 | B2 * | 1/2006 | Iizuka et al. | 215/381 |
| 7,014,056 | B2 | 3/2006 | Trude | |
| 2006/0108317 | A1 * | 5/2006 | Tanaka et al. | 215/382 |
| 2007/0075031 | A1 * | 4/2007 | Tanaka et al. | 215/382 |

* cited by examiner

BOTTLE WITH INTRUDING MARGIN VACUUM RESPONSIVE PANELS

BACKGROUND

The present invention is directed to plastic bottles used to contain foods and beverages that include vacuum responsive panels designed to compensate for temperature induced changes in internal conditions subsequent to a filling and capping operation that occurs with the contents of the bottles at an elevated temperature.

Lightweight, thin-walled containers made of thermoplastic materials such as polyester resin are well known in the container industry. For example, polyethylene terephthalate (PET) has a wide range of applications in the field of containers for foodstuffs, flavoring materials, cosmetics beverages and so on. PET can be molded, by orientation-blowing, into transparent thin-walled containers having a high stiffness, impact strength and improved hygienic qualities with a high molding accuracy. Strong, transparent and substantially heat resistant containers may be produced by the biaxial-orientation blow-molding process in which a parison is oriented both laterally and longitudinally in a temperature range suitable for such orientation. Heat-set PET containers are particularly heat resistant. Biaxially-oriented blow-molded containers have greater stiffness and strength as well as improved gas barrier properties and transparency.

When a thermoplastic container is filled with a hot liquid (such as a liquid sterilized or Pasteurized at a high temperature) and sealed, i.e. hot-filled, subsequent thermal contraction of the liquid upon cooling results in partial evacuation of the container which tends to deform the container walls. Such deformation typically concentrates at the mechanically weaker portions of the container, which can result in an irregular and commercially unacceptable appearance. Further, if the deformation occurs in an area where the label is attached to the container, the appearance of the label may be adversely affected as a result of container deformation. By increasing the wall thickness of the container it is possible, to some extent, to strengthen the container walls and thus decrease the effects of vacuum deformation. However, increasing the wall thickness results in a substantial increase in the amount of raw materials required to produce the container and a substantial decrease in production speed. The resultant increased costs are not acceptable to the container industry.

Prior art approaches have included the use of collapse panels, i.e., indented surface areas which provide for controlled, quantified collapse to overcome thermal deformation. The collapse panels are typically spaced around the perimeter of the container by intervening lands. However, problems have developed in containers designed with collapse panels. While collapse panels accommodate a great degree of controlled deformation, as the vacuum inside the containers increases, more and more collapse is required from the collapse panels without permitting collapse of the intervening lands. A variety of structures have been adopted to focus the vacuum collapse solely within the panels. For example, U.S. Pat. No. 4,805,788 discloses a bottle wherein the walls contain collapse panels, and the collapse panels contain ribs to accommodate a high degree of evacuation of the container without deleterious changes in the container's rigidity or appearance. The ribs extended longitudinally at the sides of the collapse panels so as to isolate the movement in the collapse panels from the intervening lands.

In U.S. Pat. No. 4,863,046, longitudinal ribs are included in the center of each of the intervening lands. Additionally, lateral ribs are included in the panels to reinforce the panels against pressure or vacuum deformation. The lateral ribs in the panels are also disclosed in U.S. Pat. No. 5,005,716 and U.S. Pat. No. 5,178,290. In U.S. Pat. No. 5,092,475, the longitudinal ribs included in the center of each of the intervening lands are extended vertically beyond the vertical extent of the collapse panels. Further, the collapse panels, located in the portion of the bottle designed to accept an overlying label, include a radially inwardly offset peripheral portion from which a central boss portion projects radially outward to an outer panel, which can be located at about the same radial position as the intervening lands. The boss outer panel, which is generally rectangular with rounded corners, acts to support the overlying label and can be reinforced by a radially inwardly extending, vertical rib extending over a substantial portion of the outer panel. In U.S. Pat. No. 5,178,289, vertical stiffening ribs are disclosed in both the intervening lands and in the center of the outwardly projecting boss portions of the flex panels. Horizontal stiffening ribs are disclosed in the outwardly projecting boss portions of the flex panels in U.S. Pat. No. 5,762,221.

In U.S. Pat. No. 5,337,909 the problem of deformation of the container sidewall during vacuum compensation following hot-fill is addressed by providing circumferentially extending inwardly directed reinforcement ribs located in the immediate vicinity of, or even intersecting, the upper and lower margins of the vacuum compensation panels. A similar approach was used in U.S. Pat. No. 5,704,503 with the added element of vertically oriented longitudinal ribs in the posts between the vacuum compensation panels. Multiple discontinuous horizontal reinforcement ribs located at about the same location was disclosed in U.S. Pat. No. 6,036,037. The amount of total panel deflection can be computed based on the volume and temperature changes that are expected to occur in the container, and thus the size of the panels can be specifically scaled to accommodate the anticipated vacuum. Despite these and other attempts at structural solutions for the sidewall deformation problem, the problem persists to varying degrees in a wide variety of hot-fill containers that are commercially sold.

SUMMARY

A container exhibiting superior resistance to unwanted or uncontrolled sidewall deformation has a base and a sidewall having a lower edge coupled to the base. The side wall extends upward from the base to a sidewall upper edge. A shoulder portion is coupled to the sidewall upper edge. The shoulder portion leads upward and radially inward to a neck portion. The sidewall and shoulder portions can optionally include radially inwardly or outwardly projecting hoop reinforcement rings. A finish is coupled to the neck portion that is adapted to receive a closure. The finish surrounds an opening leading to the plastic bottle interior. A plurality of vacuum responsive panels is generally uniformly spaced around the side wall periphery. Each vacuum responsive panel includes a panel surface portion that can be radially inset from the sidewall. A post or land is provided between each nearest neighbor pair of vacuum panels. The posts have upper and lower ends that can be joined together by the upper and lower sidewall edge portions. A margin is located at least at the upper and lower edges of each vacuum panel. The margin extends between the panel surface and the sidewall. At least one of the upper and lower margins of each vacuum responsive panel includes a geometrically defined weak point, which in response to decreasing pressure within the bottle focuses any initial deflection of the panel surface to that portion of the panel immediately contiguous to the weak point. This focusing and/or control of the initial point of deflection assists in preventing random deflection of the panels. The avoidance of random panel deflections contributes to preventing unwanted sidewall deformation, particularly in the area of the corners of the vacuum responsive panels that often leads to column failure of the posts or lands.

The geometrically defined weak point can take axially offset intrusion into the upper and/or lower margin of the vacuum responsive panels, the intrusion being clearly spaced from the geometry defining the corners of the vacuum responsive panels. The weak point desirably takes the form of an axially offset portion on one of the upper and lower margins that is preferably centrally positioned between the posts that separate adjacent vacuum responsive panels, and can be present on both the upper and lower edges of every vacuum panel. The surface of each vacuum responsive panel is generally convex in the absence of any pressure differential between the inside and outside of the bottle. With any decreasing pressure within the bottle, the panel surface of each vacuum responsive panel becomes decreasingly convex, starting at the axially offset portions of each margin. The panels can be sized in relation to the bottle volume as a whole so that at the expected maximum pressure differential, the vacuum responsive panels are substantially planar. The transformation of the vacuum responsive panels from generally convex to substantially planar increases the compressive resistance of the bottle so that sidewall deformation under maximum pressure differential is avoided.

In a preferred embodiment, the upper and lower margins of the sidewall are cylindrical and uniformly spaced from an axis of the bottle passing though the center of the bottle base and the center of the bottle neck. The posts can have a radius of curvature similar to or identical with the upper and lower margins of the sidewall so that the posts can be viewed as cylindrical extensions of the sidewall upper and lower edge portions. Each vacuum responsive panel can be separated from the immediately adjacent posts by the margin that surrounds the vacuum panel surface. While the posts and sidewall upper and lower edge portions can be seen to have a first radius of curvature, the panel surface of each vacuum responsive panel has a smaller radius of curvature in the absence of a pressure differential across the panel wall. With decreasing pressure within the bottle, as a result of the post-filling cooling of the bottle and contents, the radius of curvature of the vacuum responsive panels increases, with the increase beginning in the vicinity of the weak points created by the axially offset intruding portions of each margin.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF A PREFERRED EMBODIMENT

Figure 1:
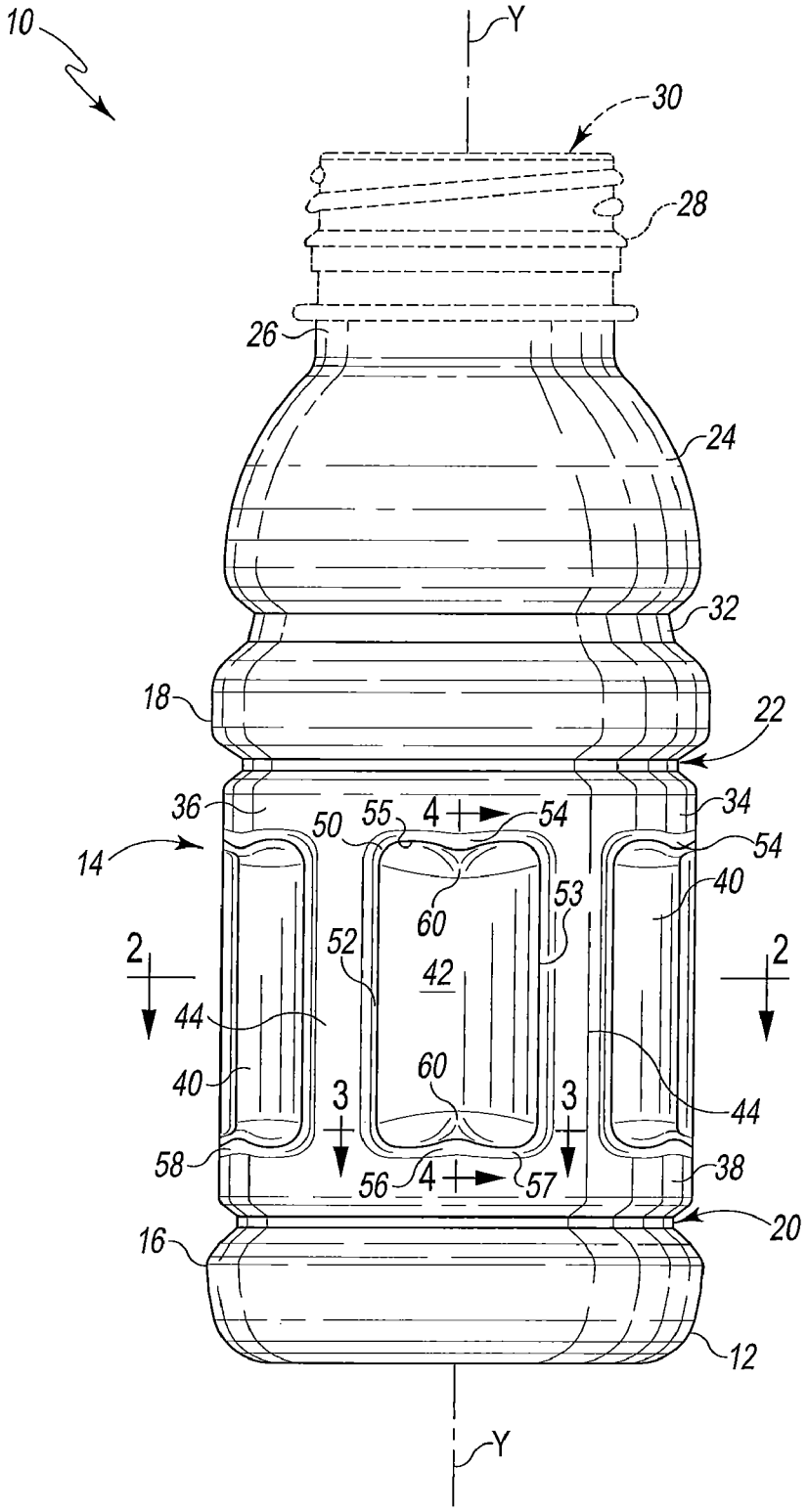
FIG. 1 is a side elevation view of a bottle embodying the present invention.

A bottle 10 of the present invention is shown in FIGS. 1 to 6 to include a base 12. A sidewall 14 having a lower edge 16 is coupled to the base 12. It will be understood that the word "coupled" is used in this disclosure to include structures that are simultaneously molded as a single unit, and is not used to suggest necessarily any assembly of parts subsequent to the formation of those parts. The side wall 14 extends upward from the lower edge 16 to a sidewall upper edge 18. The sidewall lower edge 16 is shown to include a hoop reinforcement ring 20. The sidewall upper edge 18 is shown to include another hoop reinforcement ring 22. A shoulder portion 24 is coupled to the sidewall upper edge 18. The shoulder portion 24 leads upward and radially inward to a neck portion 26. A finish 28 is coupled to the neck portion 26. The finish 28 is adapted to receive a closure, not shown. The finish 28 surrounds an opening 30 leading to the interior of the bottle 10. The shoulder portion 24 is shown to include a further hoop reinforcement ring 32.

The sidewall 14 is shown to have a generally cylindrical surface portion 34 that is axially symmetric about a vertical axis Y. The cylindrical surface portion 34 includes a portion 36 immediately below the hoop reinforcement ring 22, and a portion 38 immediately above the hoop reinforcement ring 20. A plurality of vacuum responsive panels 40 are generally uniformly spaced around the side wall 14 and extend vertically from portion 36 to portion 38. Each vacuum responsive panel 40 includes a panel surface portion 42 that is generally radially inset from the sidewall surface 34. Posts 44, having upper ends 46 and lower ends 48, separate each vacuum panel 40 from the nearest neighbor vacuum panels. The upper and lower ends of the posts 44 are joined to the sidewall surface 34 by the upper and lower sidewall edge portions 36, 38.

A margin surface 50 surrounds the panel surface portion 42 of each vacuum responsive panel 40. The margin surface 50 connects the panel surface portion 42 to the sidewall surface 34. Lateral portions 52 of the margin surface 50 connect the lateral edges 53 of each vacuum responsive panel 40 to the posts 44. The margin surface 50 can be located at an upper edge 55 of the vacuum responsive panel 40, and an upper portion 54 of the margin surface 50 connects the panel surface portion 42 to the upper sidewall edge 36. The margin surface 50 can be located at a lower edge 57 of the vacuum responsive panel 40, and a lower portion 56 of the margin surface 50 connects the panel surface portion 42 to the lower sidewall edge 38. The upper margin 54 and lower margin 56 of each vacuum responsive panel 40 is shown to include a weak point in the form of an axially offset intruding portion 58 that can be centrally situated between the posts 44. The axially offset intruding portion 58 can be presented in the form of an axial intrusion of the margin surface 50 at the center of at least one of the upper and lower edges 55, 57 of each vacuum responsive panel 40.

Figure 2:
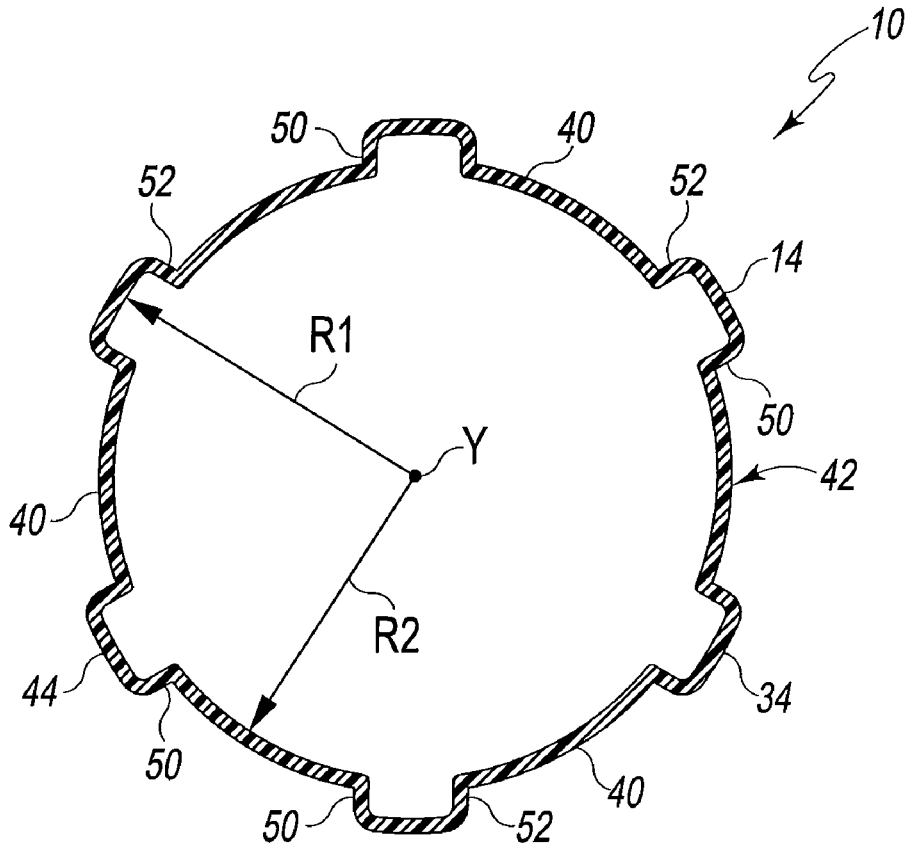
FIG. 2 is sectional view of the bottle shown in FIG. 1 taken along line 2-2.

By way of further illustration, FIG. 2 shows a sectional view of the bottle 10, taken through line 2-2 of FIG. 1, when the bottle 10 is undistorted by pressure or vacuum. It will be seen in FIG. 2 that, at the vertical center of the vacuum responsive panels 40, the sidewall surfaces 34 of the posts 44 are cylindrical and uniformly spaced by a radius $R_1$ from the axis Y of the bottle 10. The surfaces 42 of the vacuum responsive panels 40 are also generally cylindrical and uniformly spaced by a radius $R_2$ from the axis Y of the bottle 10. The lateral portions 52 of the margin surface 50 can be seen in FIG. 2 as a transition connecting the panel surface 42 to the sidewall surface 34 that is nearly radial in character, however the lateral portions 52 of the margin surface 50 need not be radial.

Figure 3:
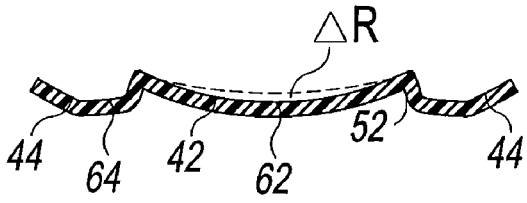
FIG. 3 is a sectional detail view of a portion of the bottle shown in FIG. 1 taken along line 3-3.

In the detail sectional view of FIG. 3, illustrating the bottle 10 in the absence of any pressure differential across the sidewall 14, it will be seen that the portions 60 of the panels 40 immediately adjacent to the axially offset intruding portions 58 of the margin 50 are no longer cylindrical. Instead, the panel surface 42 includes a central portion 62 defining a weak point, midway between the posts 44, which is at some greater distance $\Delta R$ than the radius $R_2$ from the axis Y of the bottle 10 as compared to the remainder of the surface 42, designated in phantom. It will also be noted that the lateral portions 52 of the margin surface 50 immediately adjacent to the axially offset portions 58 of the margin 50 are of smaller radial dimension and can be further characterized by outwardly inclined portions 64.

Figure 4:
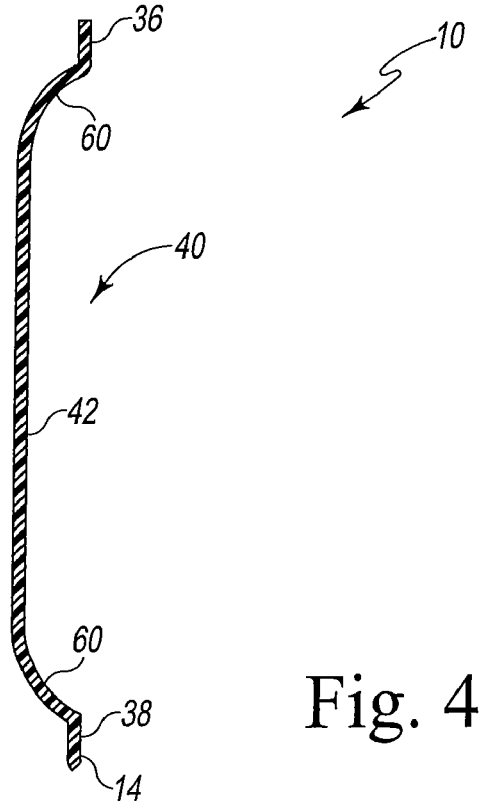
FIG. 4 is a sectional detail view of a portion of the bottle shown in FIG. 1 taken along line 4-4.

The detail sectional view of FIG. 4 is taken through the center of one of the panels 40 of the bottle 10 in the absence of any pressure differential across the sidewall 14. It will be seen that the axially offset intruding portions 58 of the margin 50 form, in the plane of the section, curved surfaces 60 that start perpendicular to the upper and lower portions 36 and 38 and then smoothly curve to become substantially coplanar with surface 42 of the panel 40. On either side of the curved surfaces 60 the margin surface 50 blends toward the more radial character illustrated in the lateral portions 52. In response to any decrease pressure within the bottle 10, the weak point created by the axially offset portions 58 focus any initial deflection of the panel surface 42 to the portion 60 of the panel 40 that is contiguous to the axial offset portions 58 of margin 50.

Figure 5:
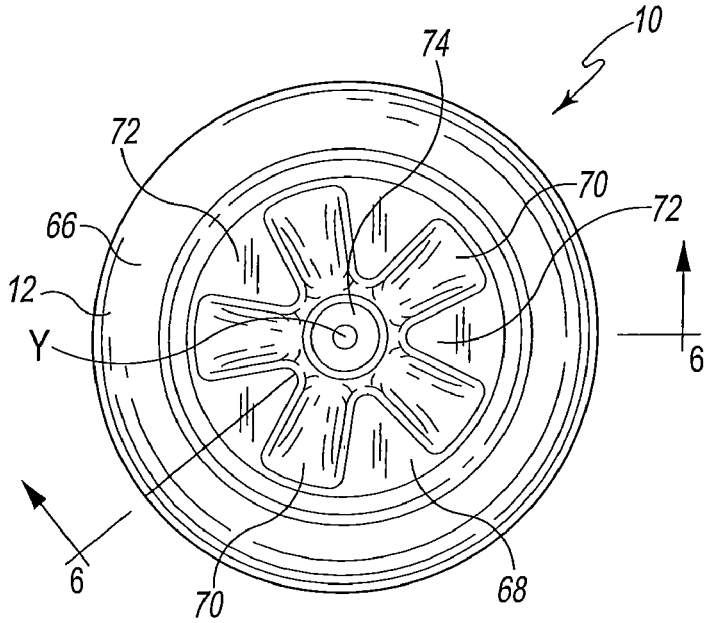
FIG. 5 is a bottom plan view of the bottle shown in FIG. 1

The base 12 of the container 10 can take the form shown in FIG. 5. The base 12 can have a generally planar support ring 66 on which the container 10 stands on any underlying support surface. The base 12 can also include a central portion 68 that is upwardly off-set above the support ring 66 as shown FIG. 6. The central portion 68 of the base 12 can include a plurality upwardly domed segments 70 and angular ribs 72 that are interspersed with each other around an axial portion 74 aligned with the vertical axis Y of the container 10. Other base designs can also be used with the present container 10, which can include pressure or vacuum compensation areas.

Figure 6:
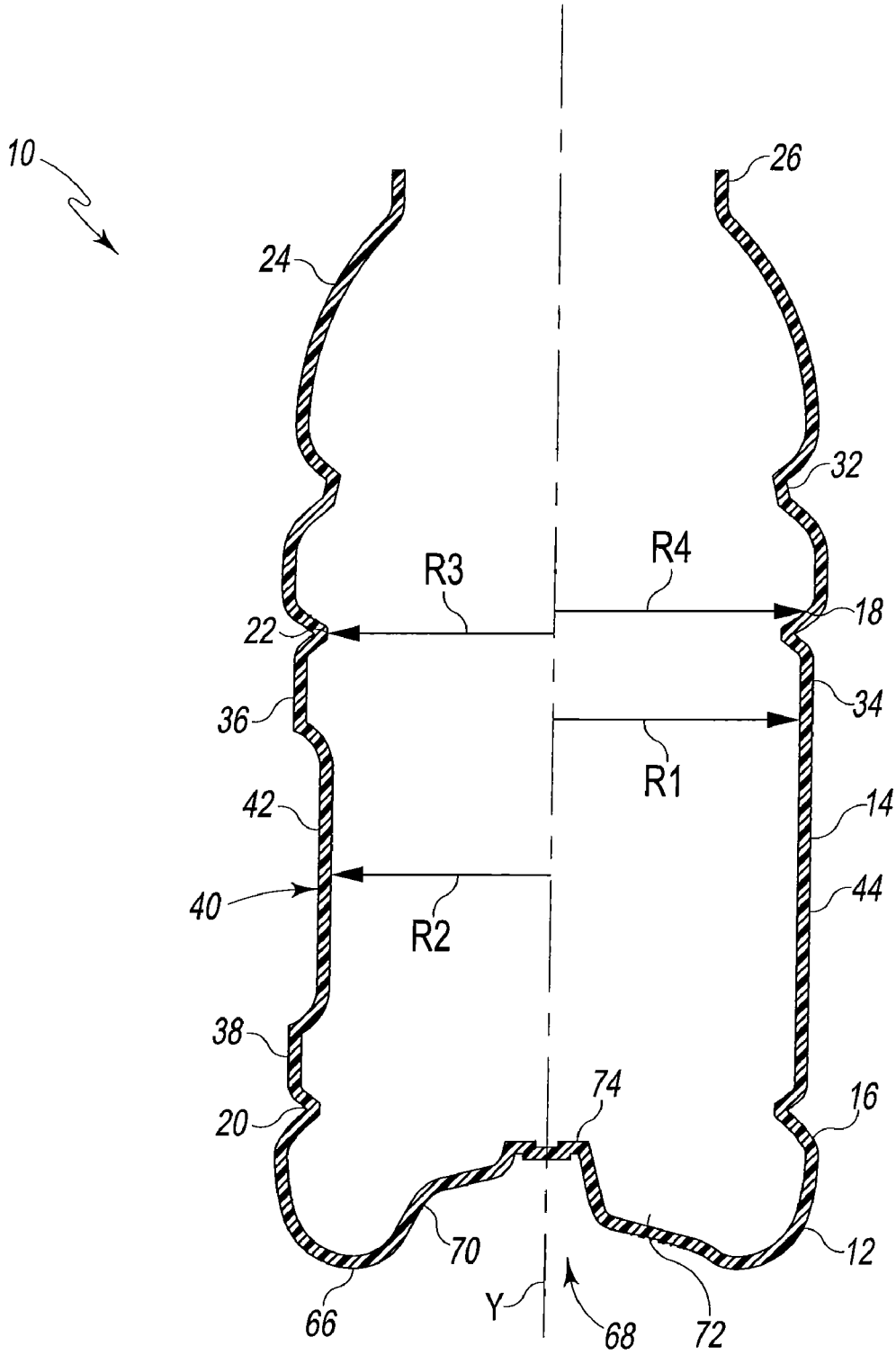
FIG. 6 is a vertical sectional outline view of the bottle shown in FIG. 1 taken along line 6-6 from FIG. 5.

FIG. 6 shows in outline a vertical section through two portions of the container 10 in the absence of any pressure differential across the sidewall 14. The portion of the container 10 above the neck portion 26 is omitted for simplicity. The left side of FIG. 6 shows a sectional view through the center of a panel 40 of container 10, while the right side shows a sectional view through a post 44. The majority of the surface 42 of the panel 40 is seen to be initially situated at a distance $R_2$ from the vertical axis Y, which can be slightly less than the radial position $R_3$ of the reinforcing rings 20 and 22. The outermost radius $R_4$ of the sidewall lower edge 16 and sidewall upper edge 18 can be greater than the radius $R_1$ of the sidewall surface 34 to define lower and upper boundaries of a label, not shown, which can overlie the sidewall 14.

When a container 10 is hot-filled, capped and cooled, the developing vacuum within the container causes an inward displacement of the surfaces 42 of the panels 40. The inward displacement is controlled by the weak points created by the axially offset portions 58, which tend to focus any initial deflection of the panel surface 42 to the portion 60 of the panel 40 that is contiguous to the axial offset portions 58 of margin 50. The radius of curvature of the vacuum responsive panels 40 increases, with the increase beginning in the vicinity of the axially offset portions 58 of each margin 50 spaced away from the posts 44. As the inward displacement continues, the vertical center of the panel surfaces 42 may become substantially planar, which has the effect of creating, with the posts 44, a structure that is able to resist sidewall deformation.

While these features have been disclosed in connection with the illustrated preferred embodiment, other embodiments of the invention will be apparent to those skilled in the art that come within the spirit of the invention as defined in the following claims.

The invention claimed is:

1. A plastic bottle comprising:

a base, a sidewall having a lower edge coupled to the base, the sidewall extending upward from the base to a sidewall upper edge, a shoulder portion coupled to the sidewall upper edge and leading upward and radially inward to a neck portion, a finish coupled to the neck portion adapted to receive a closure, the finish surrounding an opening leading to a plastic bottle interior, the sidewall including a plurality of vacuum responsive panels uniformly spaced around a sidewall periphery, each vacuum responsive panel including a panel surface radially inset from the sidewall, posts, having upper and lower ends, separating each vacuum responsive panel from nearest neighbor vacuum responsive panels, the upper and lower ends of the posts being joined together by the sidewall upper edge and the sidewall lower edge, and a margin located at least at upper and lower edges of each vacuum responsive panel extending between the panel surface and the sidewall, at least one of the margins located at the upper and lower edges of each vacuum responsive panel including an axially offset intruding portion at a center of one of the upper and lower edges of each vacuum responsive panel, the axially offset intruding portion focusing any initial deflection of the panel surface in response to decreasing pressure within the bottle, the axially offset intruding portion forming a curved surface extending between the panel surface and the adjacent sidewall, the curved surface being perpendicular to the sidewall at the upper or lower edge of the sidewall and becoming substantially coplanar with the panel surface.

2. The plastic bottle of claim 1, wherein the sidewall upper and lower edges are cylindrical.

3. The plastic bottle of claim 2, wherein the posts comprise cylindrical extensions of the sidewall upper and lower edge portions.

4. The plastic bottle of claim 3, wherein the posts and sidewall upper and lower edge portions have a first radius of curvature, and the panel surface of each vacuum responsive panel has a smaller radius of curvature in the absence of an pressure differential.

5. The plastic bottle of claim 1, wherein the panel surface of each vacuum responsive panel is convex in the absence of any pressure differential.

6. The plastic bottle of claim 5, wherein the panel surface of each vacuum responsive panel becomes decreasingly convex with decreasing pressure within the bottle.

7. The plastic bottle of claim 1, wherein the axially offset intruding portion of each margin is centrally positioned between the posts.

8. The plastic bottle of claim 1, wherein the margin of each of the vacuum responsive panels completely surrounds the panel surface.

9. The plastic bottle of claim 1, wherein the axially offset intruding portion is present on both the upper and lower edges of each vacuum panel.

10. A plastic bottle comprising:

a base, a sidewall having a lower edge coupled to the base, the sidewall extending upward from the base to a sidewall upper edge, a shoulder portion coupled to the sidewall upper edge and leading upward and radially inward to a neck portion, a finish coupled to the neck portion adapted to receive a closure, the finish surrounding an opening leading to a plastic bottle interior, the sidewall upper and lower sidewall edges being substantially uniformly spaced from an axis passing through a center of the base and the opening, the sidewall also including a plurality of vacuum responsive panels uniformly spaced around a sidewall periphery, each vacuum responsive panel including a panel surface radially inset toward the axis, posts separating each vacuum responsive panel from nearest neighbor vacuum responsive panels, the posts having upper and lower ends joining the sidewall upper edge and the sidewall lower edge, a surface of the posts being cylindrical extensions of the sidewall upper and lower edges, and a margin located at least at upper and lower edges of each vacuum responsive panel extending between the panel surface and the sidewall, at least one of the margins located at the upper and lower edges of each vacuum responsive panel including an axially offset curved portion at a center of the respective upper and lower edges of each vacuum responsive panel focusing any initial deflection of the panel surface in response to decreasing pressure within the bottle, wherein the posts and the sidewall upper and lower edges have a first radius of curvature, and in the absence of any pressure differential the panel surface of each vacuum responsive panel has a radius of curvature smaller than the first radius of curvature, where the radius of curvature of the panel surface increases with decreasing pressure within the bottle.

11. The plastic bottle of claim 10, wherein the axially offset curved portion of each margin is centrally positioned between the posts.

12. The plastic bottle of claim 11, wherein the axially offset curved portion is present on both the upper and lower edges of each vacuum panel.

13. The plastic bottle of claim 12, wherein the margin of each of the vacuum responsive panels completely surrounds the panel surface.

14. The plastic bottle of claim 10, wherein the panel surface of each vacuum responsive panel is convex in the absence of any pressure differential.

15. The plastic bottle of claim 14, wherein the panel surface of each vacuum responsive panel becomes decreasingly convex with decreasing pressure within the bottle.

16. The plastic bottle of claim 10, wherein the axially offset curved portion has an upper edge and a lower edge, where the axially offset curved portion is smoothly curved between the upper and lower edges thereof such that the upper edge is perpendicular to the sidewall and the lower edge is substantially coplanar with the panel surface.

17. A plastic bottle comprising:

a base, a sidewall having a lower edge coupled to the base, the sidewall extending upward from the base to a sidewall upper edge, a shoulder portion coupled to the sidewall upper edge and leading upward and radially inward to a neck portion, a finish coupled to the neck portion adapted to receive a closure, the finish surrounding an opening leading to an interior of the plastic bottle, the sidewall including a plurality of vacuum responsive panels uniformly spaced around a periphery of the sidewall, each vacuum responsive panel including a panel surface radially inset toward an axis passing through a center of the base and the opening, posts separating each vacuum responsive panel from nearest neighbor vacuum responsive panels, the posts having upper and lower ends joining the sidewall upper edge and the sidewall lower edge, each post having a surface being cylindrical extensions of the sidewall upper and lower edges, and a margin located at least at upper and lower edges of each vacuum responsive panel extending between the panel surface and the sidewall, at least one of the margins located at the upper and lower edges of each vacuum responsive panel including an axially offset curved portion at a center of the respective upper and lower edges of each vacuum responsive panel focusing any initial deflection of the panel surface in response to decreasing pressure within the bottle, wherein the axially offset curved portion has an upper edge and a lower edge, where the axially offset curved portion is smoothly curved between the upper and lower edges thereof such that the upper edge is perpendicular to the sidewall and the lower edge is substantially coplanar with the panel surface.

18. The plastic bottle of claim 17, wherein the posts and the sidewall upper and lower edges have a first radius of curvature, and the panel surface of each vacuum responsive panel has a radius of curvature smaller than the first radius of curvature in the absence of any pressure differential.

19. The plastic bottle of claim 17, wherein the panel surface of each vacuum responsive panel has a radius of curvature in the absence of any pressure differential, wherein the radius of curvature of the panel surface increases with decreasing pressure within the bottle.

* * * * *